US007813227B2

(12) United States Patent
Subilia et al.

(10) Patent No.: US 7,813,227 B2
(45) Date of Patent: Oct. 12, 2010

(54) MUSICAL MODULE FOR A WATCH MOVEMENT

(75) Inventors: Philippe Subilia, Rivaz (CH); Nicolas Court, Sainte-Croix (CH)

(73) Assignee: Montres Breguet S.A. (CH)

( * ) Notice: Subject to any disclaimer, the term of this patent is extended or adjusted under 35 U.S.C. 154(b) by 0 days.

(21) Appl. No.: 12/769,682

(22) Filed: Apr. 29, 2010

(65) Prior Publication Data

US 2010/0208556 A1 Aug. 19, 2010

Related U.S. Application Data

(63) Continuation of application No. 11/912,377, filed on Oct. 23, 2007, now Pat. No. 7,733,744.

(51) Int. Cl.
*G04B 21/00* (2006.01)

(52) U.S. Cl. ..... 368/272

(58) Field of Classification Search ..... 368/75, 368/272–275; 84/94.1, 97, 99
See application file for complete search history.

(56) References Cited

U.S. PATENT DOCUMENTS

| | | | | |
|---|---|---|---|---|
| 454,299 | A | 6/1891 | Shuman | |
| 749,826 | A | 1/1904 | Rod | |
| 2,509,871 | A | 5/1950 | Loeffler | |
| 2,665,544 | A | 1/1954 | Rowe | |
| 3,097,850 | A | 7/1963 | Curci | |
| 6,422,739 | B1 * | 7/2002 | Hara et al. | 368/209 |
| 7,031,230 | B1 * | 4/2006 | Nagasaka et al. | 368/204 |
| 7,590,030 | B2 * | 9/2009 | Moteki et al. | 368/75 |

FOREIGN PATENT DOCUMENTS

| | | |
|---|---|---|
| CH | 8631 | 12/1894 |
| CH | 320410 | 3/1957 |

* cited by examiner

*Primary Examiner*—Edwin A. Leon
(74) *Attorney, Agent, or Firm*—Galbreath Law Offices, P.C.; John A. Galbreath

(57) ABSTRACT

A musical module for a watch movement, said module comprising a barrel (11), at least one part (5) having pins (12), a comb (13) with a number of tines, a regulating system (7, 8, 9, 10), and a control device (16, 17, 21). The part (5) or each part (5) is a toothed disc driven by the barrel (11) via at least one pinion (6). The or each toothed disc (5) with said pins (12) on at least one face is able to be positioned over or underneath the comb (13) so that the pins (12) act on the tines of the comb (13) to play a tune. The control device (16, 17, 21) is designed to trigger a rotation of the toothed disc or discs (5) in order to start the tune. The regulating system (7, 8, 9, 10) maintains a constant rotation of the toothed disc or discs (5).

15 Claims, 3 Drawing Sheets

MUSICAL MODULE FOR A WATCH MOVEMENT

CROSS REFERENCES TO RELATED APPLICATIONS

This application is a continuation of U.S. patent application Ser. No. 11/912,377, filed Oct. 23, 2007 now U.S. Pat. No. 7,733,744 and titled "Musical Module for a Watch Movement". Applicant claims priority from and the benefit of said application, and said application is expressly incorporated by reference herein.

BACKGROUND OF THE INVENTION (1) Field of the Invention

The present invention relates to horology and more particularly to a musical module for a watch movement, especially a wristwatch, as well as to a watch comprising the musical module.

(2) Description of Related Art

The prior art already includes watches comprising a musical module adapted to a watch movement. CA966705 discloses a musical module having the fundamental elements of a musical box, namely a barrel, a cylinder, a comb and a speed regulator. These elements were modified to make them as compact as possible so that they could be integrated into a watch case.

The main problem with that module is that it can only play one tune. The amount of space required and the geometry of the cylinder does not allow more than one cylinder to be installed, at least not at this scale.

BRIEF SUMMARY OF THE INVENTION

The object of the present invention is to provide a musical module having at least one toothed musical disc provided with pins, said disc replacing the cylinder and thus requiring less space, allowing the musical module to comprise if desired several discs which can then be positioned in turn over the comb so that several tunes can be played.

In accordance with the invention, this object is achieved with a musical module for a watch movement, said module comprising a barrel, at least one part having pins, a comb with a number of tines, a regulating system, and a control device. The part or each part is a toothed disc driven by the barrel via at least one pinion. The or each toothed disc with said pins on at least one face is able to be positioned over or underneath the comb so that the pins act on the tines of the comb to play a tune. The control device is designed to trigger a rotation of the toothed disc or discs in order to start the tune. The regulating system maintains a constant rotation of the toothed disc or discs.

The features of the invention will be made clearer by a description of an embodiment given purely by way of example, no limitation being implied, with reference to the schematic figures in which:

DETAILED DESCRIPTION OF THE INVENTION

Figure 2:
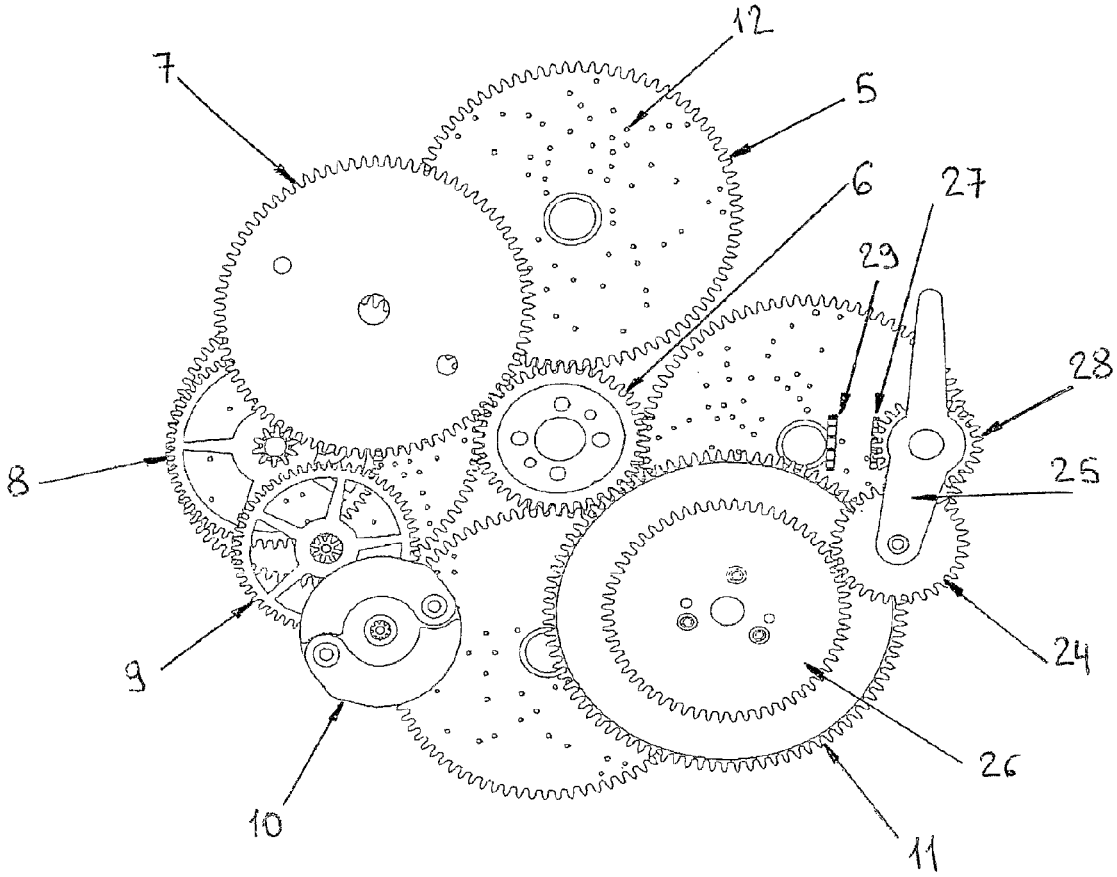
FIG. 2 is an intermediate bottom view of the musical module.

In the main embodiment of the present invention, the musical module comprises a carousel (1) with four arms (2) arranged around a central arbor (3). Near its end, each arm (2) has an arbor (4) on which is mounted one of four toothed musical discs (5). A central pinion (6) is mounted idly on the central arbor (3) of the carousel (1) in order to be able to drive on the one hand simultaneously the four musical discs (5) and on the other hand a first wheel (7) of a gear train (7, 8, 9) working together with an inertial flywheel (10). The gear train (7, 8, 9) and the inertial flywheel (10) constitute the regulating system of the musical module (FIG. 2). The central pinion (6) is drivable by the barrel (11).

Each musical disc (5) has pins (12) on its underside for lifting the tines of a comb (13) when the four discs (5) are positioned in turn over the latter. The positions of the pins (12) vary from disc (5) to disc (5) in order to give each of the musical discs (5) its own tune.

The musical module has a control device for triggering both the rotation of the discs (5) and the rotation of the carousel (1) through 90 degrees. For this purpose, a rotary member (14) which has a tooth (14*a*) is fixed to the first wheel (7) of the gear train (7, 8, 9), the tooth (14*a*) being arranged to drive a Geneva wheel (15) mounted on the central arbor (3) of the carousel (1). The pitch circle of the musical discs (5) is identical to that of the first wheel (7) so that rotation of the carousel (1) is triggered by the tooth (14*a*) only when the disc (5) positioned over the comb (13) has completed one revolution and the tune has finished.

Figure 1:
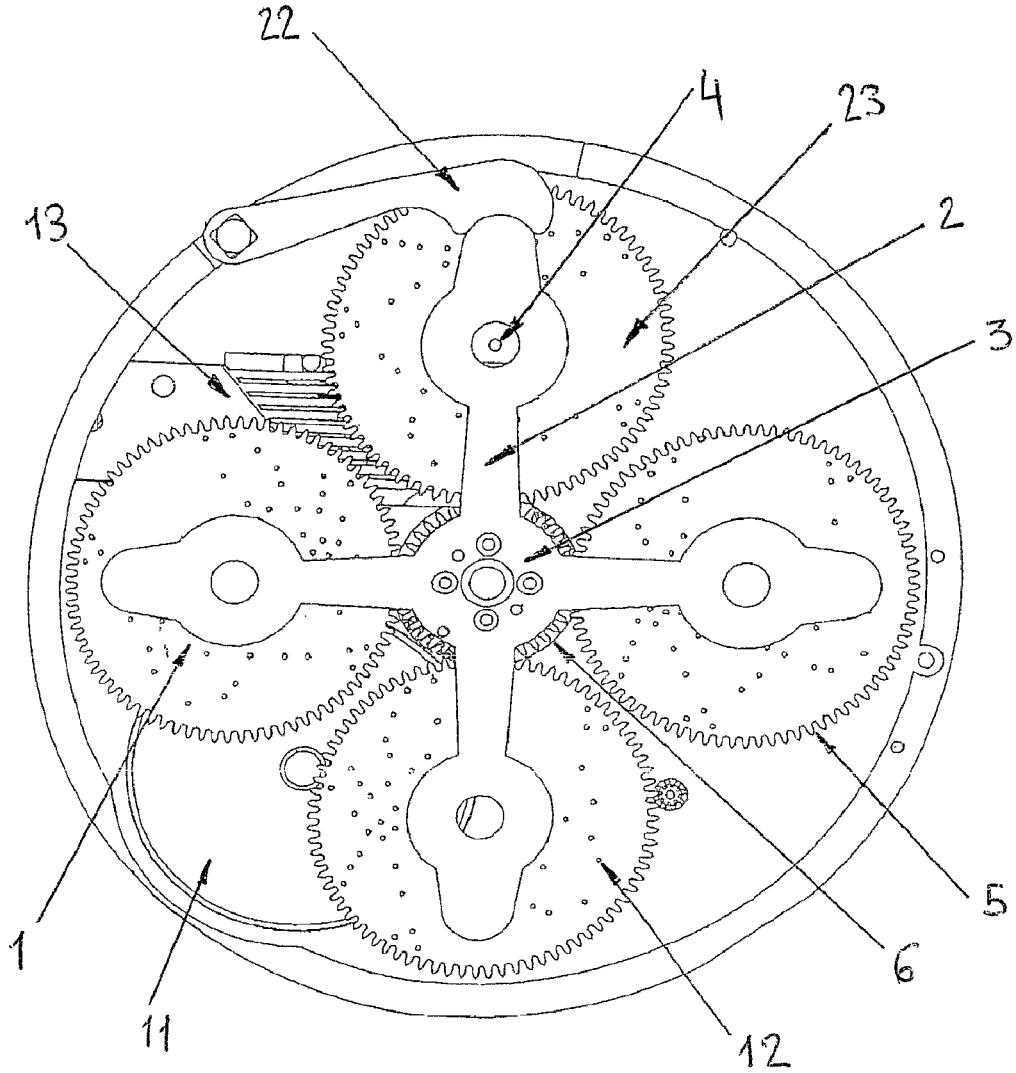
FIG. 1 is a top view of the musical module comprising a carousel with four arms, with a pinned musical disc mounted on the end of each arm.

The rotary member (14) has an annular groove (18), on the inner wall of which is a projection (19) to lock the carousel (1) through a first stop pin (16*a*) on a locking lever (16). The latter is able to operate a lever (22) (FIG. 1) which is used to keep the carousel (1) in a stable position while a musical disc (5) is being played. The outer wall of the groove (18) has a notch (20) into which there drops a second stop pin (17*a*) on a stop lever (17) designed to stop the inertial flywheel (10) in order to keep the musical module stationary.

These two levers (16, 17) are operable by a rocker (21) in order to release the carousel (1) and the flywheel (10), respectively, as described below.

Operation of the rocker (21) disengages on the one hand the first stop pin (16*a*) of the locking lever (16) from the projection (19)—said lever (16) operating the lever (22) so as to unlock the carousel (1), and on the other hand the second pin (17*a*) from the notch (20) so as to release the flywheel (10) thereby freeing the gear train (7, 8, 9) and the central pinion (6) which is immediately driven by the barrel (11).

When the control device (16, 17, 21) is operated, the following sequence of movement is triggered: the rocker (21) operates the locking lever (16) through a pin (21*a*) to disengage the first stop pin (16*a*) from the projection (19), the lever (22) is operated by the locking lever (16), thereby unlocking the carousel (1), the rocker (21) operates the stop lever (17) to disengage the second stop pin (17*a*) from the notch (20), thereby releasing the flywheel (10), the gear train (7, 8, 9) is immediately released and driven by the central pinion (6), the latter being driven by the barrel (11), and said pinion (6) also driving the four musical discs (5) simultaneously, the rotary member (14) turns and, through its tooth (14*a*), drives the Geneva wheel (15), which turns the carousel (1) through 90 degrees, one of the discs (5), which is still being driven by the central pinion (6), positions itself over the comb (13) and operates its tines so that a tune is played, the second stop pin (17*a*) travels around the outer wall of the groove (18) which acts as a cam to keep the stop lever (17) disengaged from the flywheel (10) while one of the musical discs (5) is being played, as soon as the musical disc (5) has completed one revolution, the second stop pin (17*a*) drops back into the notch (20), and stops the inertial flywheel (10) through the stop lever (17), and the first pin (16*a*) of the locking lever (16) moves back into contact with the projection (19), and the module stops.

The musical module plays a musical disc (5) when a control button (not shown) operates the rocker (21).

A feature of the musical discs (5) is that they possess an area (23) which has no pins (12) in order to allow each to be positioned in turn over the comb (13) without the pins (12) striking the tines of the comb while it is being moved into position.

The musical module also comprises a wheel (24) (FIG. 2) mounted on a rocker (25), said wheel (24) being designed to drive the ratchet wheel (26) of the barrel (11) when the watch winding button (not shown) is turned in the clockwise direction. The wheel (24) is then driven via a first winding pinion (27) and an intermediate pinion (28).

A second winding pinion (29) is designed to wind up the watch movement when the winding button is turned in the counterclockwise direction.

Figure 3:
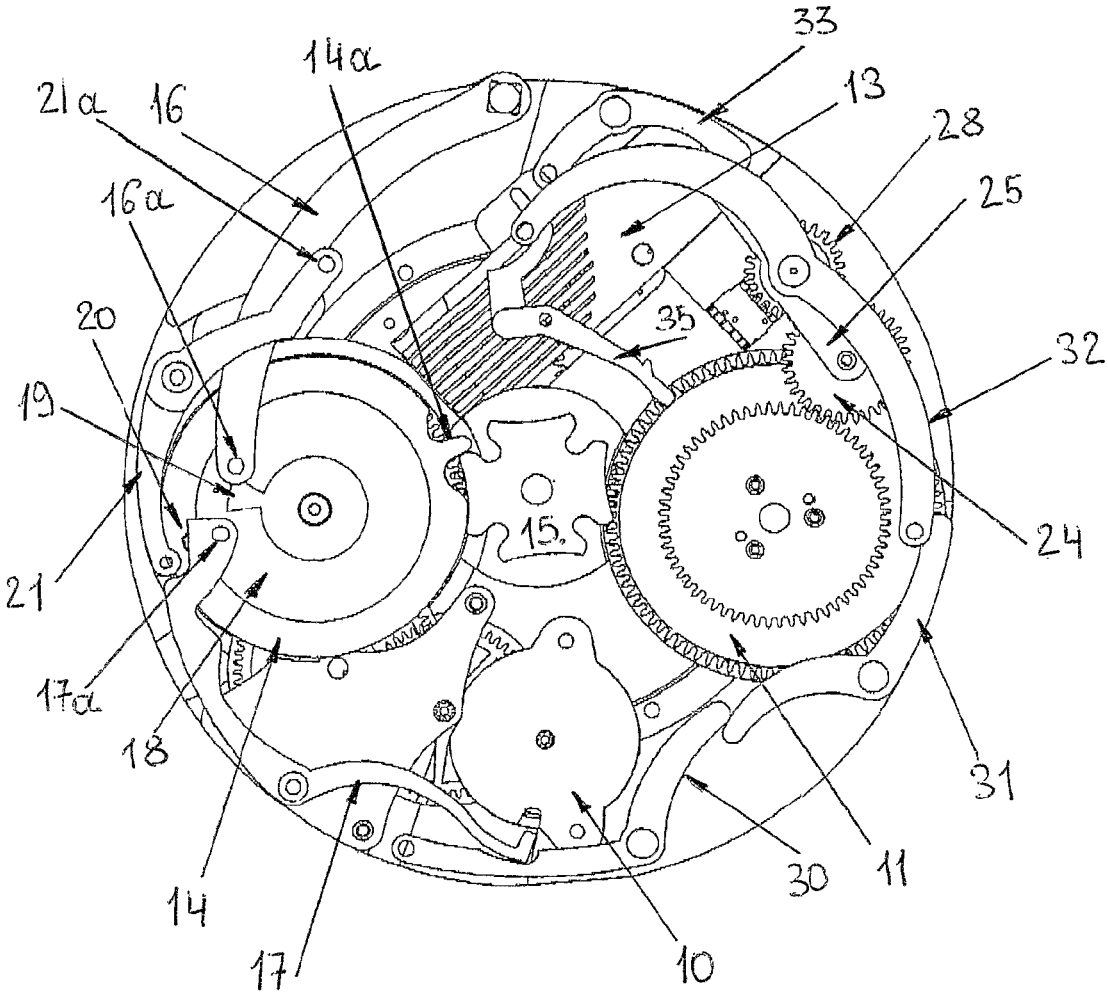
FIG. 3 is a bottom view of the musical module.

The watch is set to the correct time by turning the winding button and simultaneously pressing a time-setting button (not shown). This button, acting through a set of rockers (30, 31, 32, 33, 25, 35) (FIG. 3) both disengages the rocker (25) to prevent the musical module being wound up, and operates a rocker (35) acting on the watch movement in order to set the time.

It goes without saying that the invention is not limited to the embodiment described above by way of example but that on the contrary it encompasses all alternative embodiments. As an example, the musical module could be adapted for a minute repetition.

We claim:

1. Musical module for a watch movement, said module including a barrel (11), at least one element (5) with pins (12), a comb (13) with a number of tines, a regulating member (7, 8, 9, 10) and a control device (16, 17, 21), wherein the element (5) or each element (5) is a toothed disc driven by the barrel (11) via at least one pinion (6), the or each toothed disc (5) carrying said pins (12) on at least one face, being able to be positioned over or underneath the comb (13) such that the pins (12) cooperate with the tines of the comb (3) to play a tune, the control device (16, 17, 21) being arranged to trigger the rotation of the toothed disc(s) (5) in order to start the tune, the regulating member (7, 8, 9, 10) ensuring constant rotation of the toothed disc(s) (5), said musical module being characterized in that said control device includes at least one locking lever (17) that acts to release the rotation of said at least one pinion (6) arranged between a toothed disc or each toothed disc and said barrel (11), in that said pinion (6) cooperates with a gear train (7, 8, 9, 10), in that said pinion (6) and said gear train (7, 8, 9, 10) extend in a parallel plane to the plane of the movement and in that said locking lever is arranged so as to lock said gear train.

2. Musical module according to claim 1, characterized in that each rotating toothed disc (5) has teeth over the entire circumference thereof.

3. Musical module according to claim 1, characterized in that the regulating member (7, 8, 9, 10) consists of a gear train (7, 8, 9) working together with an inertial flywheel (10).

4. Musical module according to claim 3, characterized in that it includes a carousel (1) that has a central arbour (3) about which several toothed discs (5) are arranged, the bottom surface of each of the toothed discs (5) including said pins (12), the pinion (6) being loosely fitted onto the central arbour of the carousel (1) in order, as soon as the control device (16, 17, 21) is operated, to drive, on the one hand, the toothed discs (5) simultaneously, and on the other hand, the first wheel (7) of the gear train (7, 8, 9), a rotating member (14) with a finger (14*a*) being arranged integral with said first wheel (7) so as to pivot the carrousel (1) and position the toothed discs (5) in turn over the comb (13).

5. Musical module according to claim 4, characterized in that the pitch circle of the first wheel (7) is approximately identical to that of the toothed discs (5), so that the finger (14) triggers rotation of the carousel (1) only after the toothed disc (5) positioned over the comb (13) has completed one revolution.

6. Musical module according to claim 4 or 5, characterized in that one part (23) of the toothed discs (5) has no pins (12), so that each toothed disc (5) can be positioned in turn over the comb (13) without the pins (12) striking the tines of the comb during positioning.

7. Musical module according to claim 4, characterized in that the carousel (1) has four arms (2) separated from each other by approximately 90° and arranged around the central arbour (3), each arm (2) having one of the toothed discs (5) towards the end thereof, a Geneva wheel (15) being secured to said central arbour (3) so as to trigger rotation of the carousel through approximately 90° when said Geneva wheel (15) is driven by the finger (14*a*) of the rotating member (14).

8. Musical module according to claim 4, characterized in that the control device (16, 17, 21) includes a lever (16) for locking the carousel (1), and a stop lever (17) for locking the flywheel (10), wherein said two levers (16, 17) can be operated by a rocker (21) to release the carousel (1) and the flywheel (10), thereby unlocking the gear train (7, 8, 9) and the central pinion (6), which is immediately driven by the barrel (11), said pinion (6) simultaneously driving the toothed discs (5).

9. Musical module according to claim 8, characterized in that the rotating member (4) includes an annular groove (18), wherein the inner wall of said groove (18) has a projecting portion (19) for locking the carousel (1) via a first stop pin (16*a*) on the locking lever (16), the latter being able to operate a lever (22), designed to keep the carousel (1) in a stable position when a musical disc (5) is being played, the outer wall of the groove (18) having a notch (20), inside which a second stop pin (17*a*) on the stop lever (17) is positioned, the rocker (21) of the control system (16, 17, 21) allowing, when operated, disengagement, on the one hand, of the first pin (16*a*) from the projecting portion (19) to disengage the lever (22) and thus release the carousel (1), and, on the other hand of the second pin (17*a*) from the notch (20) to release the flywheel (10), said musical module stopping as soon as the stop pins (16*a*, 17*a*) come back into contact with the projecting portion (19) and return to the notch (20), respectively, after the finger (14*a*) has completed one revolution and driven the carousel (1) in rotation through an angle of approximately 360°/N, where N is equal to the number of toothed discs (5) carried by the carousel (1).

10. Musical module according to claim 4, characterized in that each toothed disc (5) is designed to mesh with a pinion (6) loosely fitted onto the central arbour (3) of the carousel (1), said pinion (6) being meshed with the barrel (11) and the first wheel (7) of the gear train (7, 8, 9).

11. Musical module according to claim 10, characterized in that a rotating member (14) is arranged integral with the first wheel (7) to allow the carousel (1) to rotate as soon as the drive device (6, 14*a*, 15) is operated.

12. Musical module according to claim 7 or 11, characterized in that the rotating member (14) has a finger (14*a*) arranged to trigger rotation of the carousel (1).

13. Watch including a musical module wherein said module including a barrel (11), at least one element (5) with pins (12), a comb (13) with a number of tines, a regulating member (7, 8, 9, 10) and a control device (16, 17, 21), wherein the element (5) or each element (5) is a toothed disc driven by the barrel (11) via at least one pinion (6), the or each toothed disc (5) carrying said pins (12) on at least one face, being able to be positioned over or underneath the comb (13) such that the pins (12) cooperate with the tines of the comb (3) to play a tune, the control device (16, 17, 21) being arranged to trigger the rotation of the toothed disc(s) (5) in order to start the tune, the regulating member (7, 8, 9, 10) ensuring constant rotation of the toothed disc(s) (5), said musical module being characterized in that said control device includes at least one locking lever (17) that acts to release the rotation of said at least one pinion (6) arranged between a toothed disc or each toothed disc and said barrel (11), in that said pinion (6) cooperates with a gear train (7, 8, 9, 10), in that said pinion (6) and said gear train (7, 8, 9, 10) extend in a parallel plane to the plane of the movement and in that said locking lever cooperates with a tooth of a wheel of the gear train.

14. Watch according to claim 13 including a winding crown, characterized in that the musical module has a wheel (24) mounted on a rocker (25), said wheel (24) being arranged to drive the ratchet (26) of the barrel (11) when the winding crown is turned clockwise, the wheel (24) being driven via a first winding pinion (27) and an intermediate pinion (28).

15. Watch according to claim 14, characterized in that a second winding pinion (29) is arranged to wind the watch movement when the winding crown is turned anti-clockwise.

* * * * *